US006951324B2

(12) United States Patent
Karamanos

(10) Patent No.: US 6,951,324 B2
(45) Date of Patent: Oct. 4, 2005

(54) UNIVERSAL BRACKET FOR TRANSPORTING AN ASSEMBLED CONDUIT

(76) Inventor: John Chris Karamanos, 1931 Patio Dr., San Jose, CA (US) 95125

( * ) Notice: Subject to any disclaimer, the term of this patent is extended or adjusted under 35 U.S.C. 154(b) by 0 days.

(21) Appl. No.: 10/667,117

(22) Filed: Sep. 17, 2003

(65) Prior Publication Data

US 2005/0056752 A1 Mar. 17, 2005

(51) Int. Cl.[7] ..... F16L 3/22

(52) U.S. Cl. ..... 248/68.1; 248/49; 248/65; 248/300

(58) Field of Search ..... 174/65 R, 65 G; 138/37, 54, 106; 248/68.1, 65, 74.3, 49, 58, 59, 70, 73, 300

(56) References Cited

U.S. PATENT DOCUMENTS 1,429,776 A * 9/1922 Robinson ..... 248/74.2
2,534,690 A * 12/1950 Young, Jr. et al. ..... 248/68.1
4,123,012 A * 10/1978 Hough ..... 242/405.2
4,163,372 A * 8/1979 Frye et al. ..... 62/259.1
4,193,563 A * 3/1980 Vitale ..... 242/405.2
4,261,529 A * 4/1981 Sandberg et al. ..... 242/405.2
4,541,602 A * 9/1985 Potzas ..... 248/544
4,550,891 A * 11/1985 Schaty ..... 248/68.1
4,779,815 A * 10/1988 Moore et al. ..... 242/405.1
4,842,227 A * 6/1989 Harrington et al. ..... 248/56
5,016,843 A * 5/1991 Ward ..... 248/68.1
5,458,241 A * 10/1995 Brown ..... 206/419
5,526,931 A * 6/1996 White ..... 206/420
5,771,954 A * 6/1998 Benner et al. ..... 160/231.2
6,135,381 A * 10/2000 Teson ..... 242/404.3
6,142,405 A * 11/2000 Black ..... 242/388.6
6,170,784 B1 * 1/2001 MacDonald et al. ..... 248/65
D490,690 S * 6/2004 Brass et al. ..... D8/354
2003/0222185 A1 * 12/2003 Rubenstein et al. ..... 248/68.1

* cited by examiner

*Primary Examiner*—Ramon O. Ramirez
*Assistant Examiner*—Amy J. Sterling
(74) *Attorney, Agent, or Firm*—Townsend & Townsend & Crew LLP

(57) ABSTRACT

The invention is a mounting bracket having a generally rectangular, flat body with an outside edge, a front and a back. A first support guide for a first pipe is positioned proximate to and within the boundary of the outside edge, the first support guide having a substantially complete enclosure. A handle is formed within the boundary of and proximate to the outside edge of the body, for lifting the mounting bracket. A base is coupled to and extends outwardly from the outside edge of the body and further provides support to the body.

13 Claims, 12 Drawing Sheets

UNIVERSAL BRACKET FOR TRANSPORTING AN ASSEMBLED CONDUIT

BACKGROUND OF THE INVENTION

1. Field of the Invention

The invention relates generally to the field of hanger brackets and specifically to heating, ventilation and air-conditioning (HVAC) mounting brackets.

2. The Prior Art

Heating, cooling, ventilating and air-conditioning systems (HVAC systems) in residential, commercial, education and research buildings are usually comprised of metallic pipes, hollow composite materials such as tubes, and the like. The systems are typically supported from and between floor or ceiling joists. The HVAC system typically includes a primary or main duct. A series of smaller branch or fluid-distributing ducts extending from the main duct are mounted between adjoining floor or ceiling joists. Such main and branch duct members are normally supported by metal hangers which are placed between the joists. Often pipe and conduit lines for transporting liquid or gas comprise the branch ducts and are suspended from ceiling joists or off the wall, typically with unistrut, off-thread rod, couplings, and various hanger brackets.

Piping and conduits that supply gas and/or liquids within buildings require careful preparation. Builders, or contractors, typically use ladders or scaffolding to reach areas where piping is routed and the installation may be cumbersome. Occasionally the pipe or conduits are prepared on the ground and installed by ladder as more complete assemblies. Ground preparation of pipe and conduit assemblies yields a more unwieldy structure, but ground preparation is often more practical.

After installation, a pressure check of the piping and conduit system often reveals leaks that are time-consuming and expensive to track down. The leaks must be found and repaired with the piping already having been installed.

What is needed is a system and method for reducing the likelihood of leaks, increasing the reliability of ground-assembled systems, and reducing the cost of conduit and pipe installation.

BRIEF DESCRIPTION OF THE INVENTION

The invention comprises a mounting bracket having a body and an arm coupled to the body. A support guide is located within the arm and is configured to receive a pipe and provide support to the pipe. A base is coupled to the body attached to a platform. The base is further configured to provide support to the body. A handle is coupled to the body and is configured to maneuver the bracket, wherein the bracket is configured to maintain support for the pipe while the bracket is maneuvered by the handle.

BRIEF DESCRIPTION OF THE DRAWING FIGURES

DETAILED DESCRIPTION OF THE INVENTION

The following description of the invention is not intended to limit the scope of the invention to these embodiments, but rather to enable any person skilled in the art to make and use the invention.

Figure 1A:
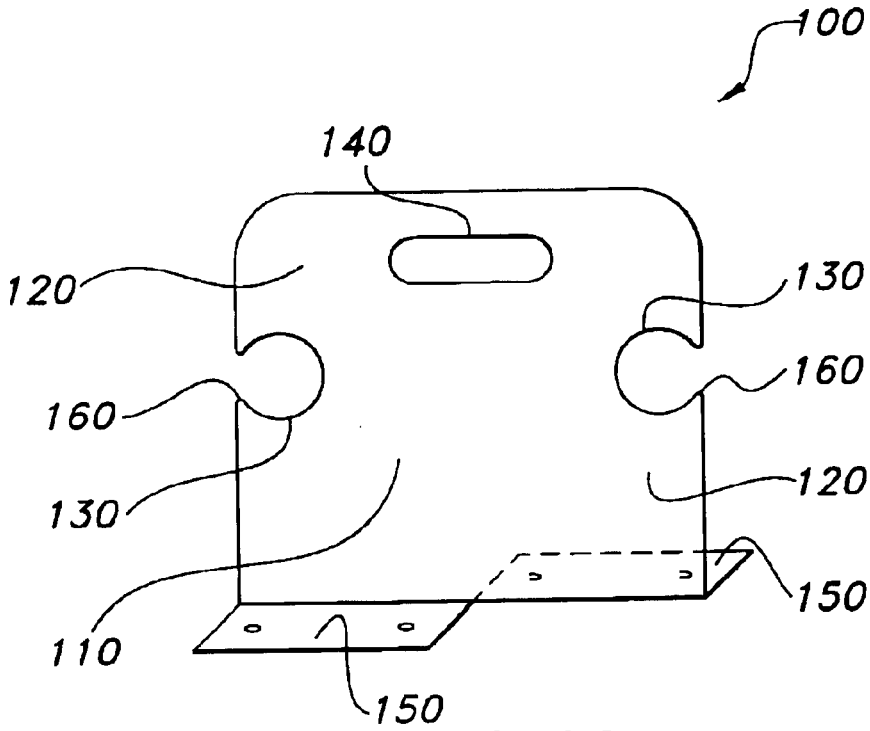
FIG. 1A is a diagram illustrating a mounting bracket for pipe or conduit with a built-in handle.

FIG. 1A is a diagram illustrating a mounting bracket for pipe or conduit with a built-in handle. Bracket 100 includes body 110, arms 120 with support guides 130. Support guides 130 may secure pipes or conduits, and may include a grommet (not shown) to assist in securing the pipe. A pipe may be inserted into support guides 130 through either support guide opening 160, on the side of support guide 130, or directly through the larger opening of support guide 130. A retaining clip, or U-clip (see FIG. 16), may be used to secure a pipe within support guide 130. The support guides support pipes by providing, either in combination with a grommet or without a grommet, friction along the pipe and maintaining alignment of the pipe at approximately 90 degrees to the plane of the bracket. One or more brackets may be used, in conjunction, to support one or more pipes. The brackets may also support, for example, electrical conduits, process pipe, fire sprinklers, cables, sheet metal duct work, and flex duct.

Handle 140 connects to bracket 100 and enables bracket 100 and a completed bracket/pipe assembly (see FIG. 1B) to be easily maneuvered and transported. Handle 140 may be shaped and sized to best accommodate a human hand, a forklift, or any other lifting device. Handle 140 may be lined with a gripping surface (not shown), for example neoprene and plastic, or be an upturned portion of the body. Although the following FIGURES illustrate the handle as a hole in the body, one of ordinary skill will recognize that a handle may be attached with, for example, screws, rivets, welding, and bolts.

Figure 1B:
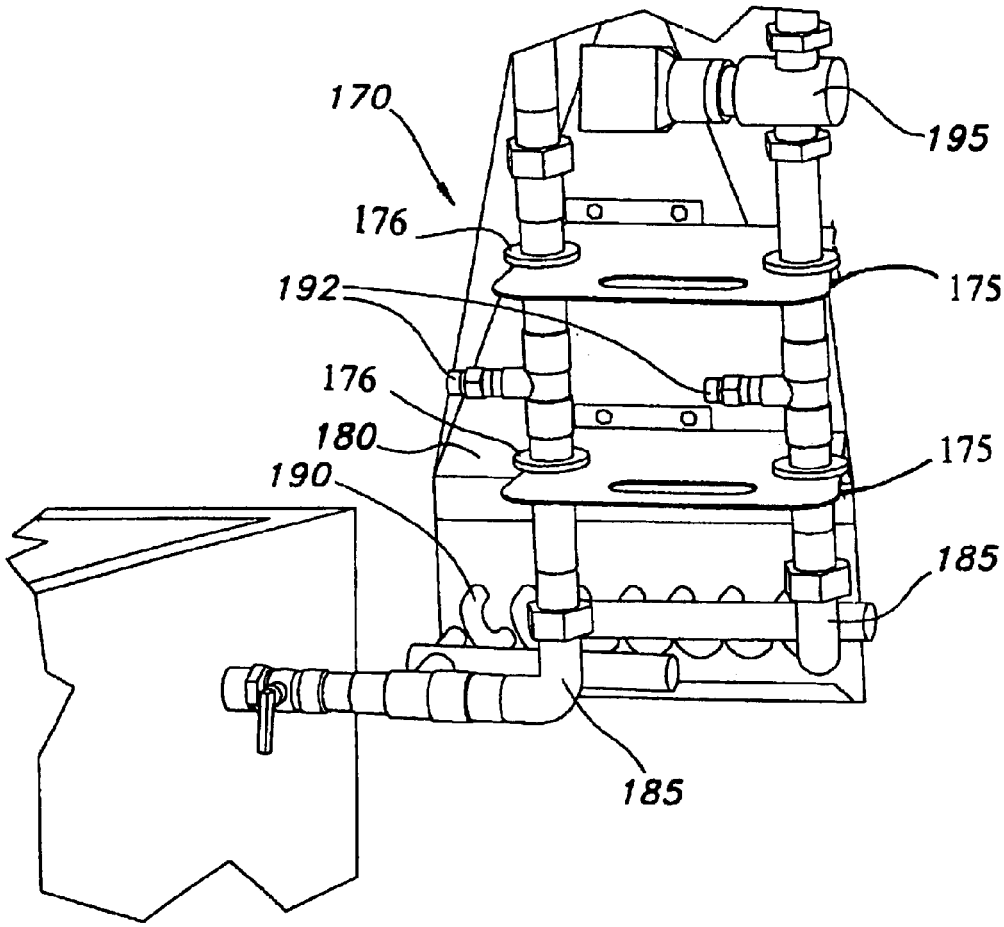
FIG. 1B is a diagram illustrating two mounting brackets from FIG. 1 supporting two pipes and attached to a duct.

Base 150 connects to body 110 and allows for bracket 100 to be mounted to a surface, for example a duct (see FIG. 1B). Bracket 100 may be mounted in any secure manner, for example welded, screwed, and bolted.

In one embodiment, the bracket is made from 18-gauge steel, it is 8 inches wide and 8 inches high, with the base protruding by 1 inch. The bracket may be constructed from any appropriate material. A pipe may be inserted into support guides 130 through either support guide opening 160, on the side of support guide 130, or directly through the larger opening of support guide 130. A retaining clip, or U-clip (see FIG. 16), may be used to secure a pipe within support guide 130. The brackets in the following FIGURES may have similar dimensions and be made out of the same variety of materials, or they may have dimensions appropriate to their use. Holes may be circular, octagonal, square, and any other appropriate shape.

One skilled in the art will recognize that the following FIGURES may not be drawn to scale with respect to the support guide openings, and that a conduit or pipe may be inserted into the bracket using multiple methods.

FIG. 1B is a diagram illustrating two brackets from FIG. 1 supporting two pipes and attached to a duct. Assembly 170 includes brackets 175 mounted on duct 180. Brackets 175 are supporting pipes 185. Brackets 175 may include grommets 176 to assist in securing pipes 185. Pipes 185 may be, for example, conduits for gas or liquid, and have coil 190, pressure/temperature ports 192, and automatic temperature control valve 195, for example. Assembly 170 may be completed after mounting brackets 175 on duct 180 or prior to mounting. One problem with completing assembly 170 on the ground, for example, prior to mounting, is that assembly 170 may be manipulated by pipes 185, coil 190, pressure/temperature ports 192, and/or automatic temperature control valve 195 during mounting, resulting in damage to the seals between the components as well as damage to the components themselves. The damage may not be noticed until a pressure test of the entire system, after which locating a leak or malfunctioning part may be time-consuming and costly. The invention solves this problem by providing a handle for manipulation that will preserve the relationship between the attached components (for example pipes 185, coil 190, pressure/temperature ports 192, automatic temperature control valve 195, Y-Strainer (not shown), circuit balancing valve (not shown), and ball valve (not shown) and provide support for assembly 170 so that completion may occur prior to mounting with a higher reliability for the integrity of the system. The handle will also help to eliminate damage to the parts themselves.

The pipes, valves, levers and coils, for example, in assembly 170 may be assembled within brackets 175 while the assembler is on the ground. Once secured and supported within brackets 175, then handles 190 may be used to maneuver assembly 170 into position for mounting on duct 180. The coils, pipes, levers and valves of the assembly maintain their positional relationship better because they are not being handled and the assembly is not being manipulated by them.

Figure 2:
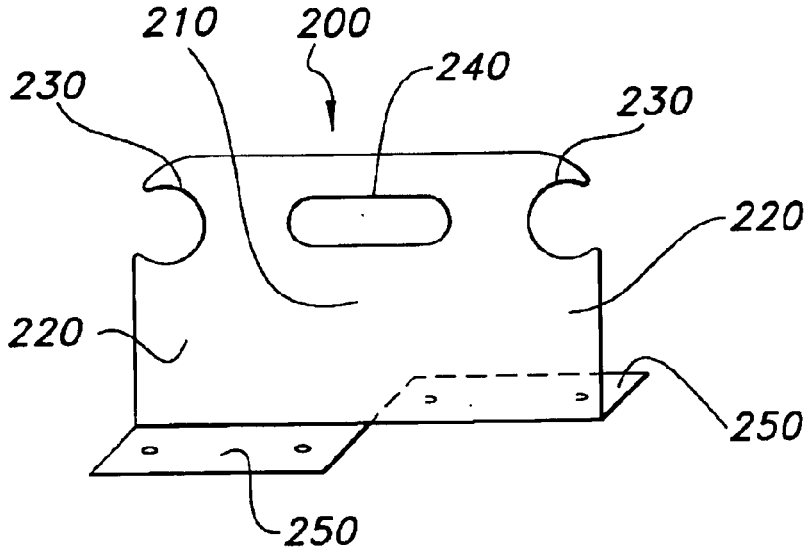
FIG. 2 is a diagram illustrating another embodiment of a mounting bracket for pipe or conduit with a built-in handle.

FIG. 2 is a diagram illustrating another embodiment of a mounting bracket for pipe or conduit with a built-in handle. Bracket 200 includes body 210, arms 220 with support guides 230. Support guides 230 may secure pipes or conduits, and may include a grommet (not shown) to assist in securing the pipe. Handle 240 connects to bracket 200 and enables bracket 200 and a completed bracket/pipe assembly (see FIG. 1B) to be easily maneuvered and transported. Handle 240 may be shaped and sized to best accommodate a human hand, a forklift, or any other lifting device. Handle 240 may be lined with a gripping surface (not shown), for example neoprene or plastic. Base 250 connects to body 210 and allows for bracket 200 to be mounted to a surface, for example a duct (see FIG. 1B). Bracket 200 may be mounted in any secure manner, for example welded, screwed, and bolted.

Figure 3:
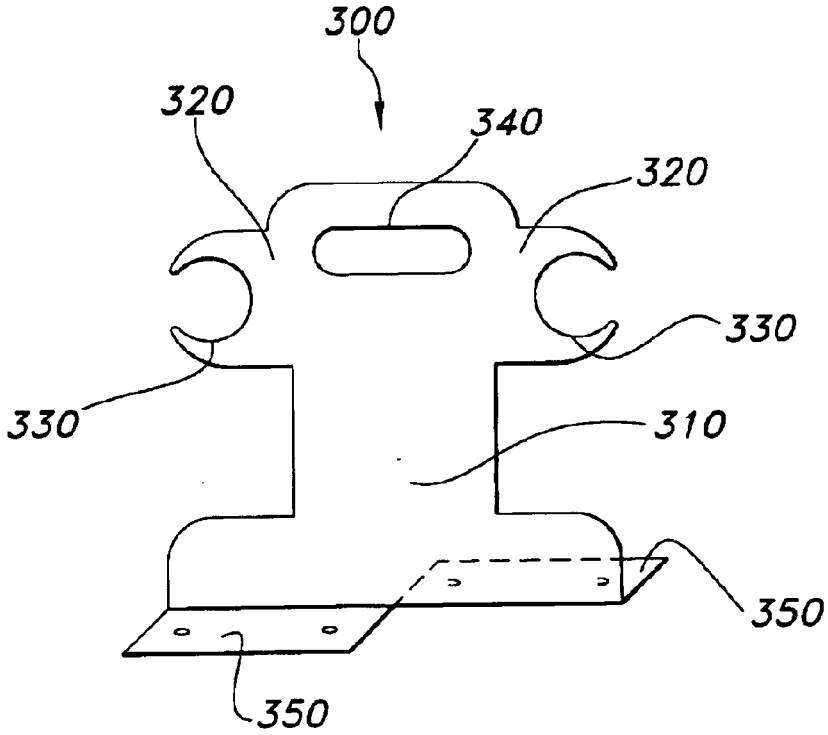
FIG. 3 is a diagram illustrating another embodiment of a mounting bracket for pipe or conduit with a built-in handle.

FIG. 3 is a diagram illustrating another embodiment of a mounting bracket for pipe or conduit with a built-in handle. Bracket 300 includes body 310, arms 320 with support guides 330. Support guides 330 may secure pipes or conduits, and may include a grommet (not shown) to assist in securing the pipe. Handle 340 connects to bracket 300 and enables bracket 300 and a completed bracket/pipe assembly (see FIG. 1B) to be easily maneuvered and transported. Handle 340 may be shaped and sized to best accommodate a human hand, a forklift, or any other lifting device. Handle 340 may be lined with a gripping surface (not shown), for example neoprene or plastic. Base 350 connects to body 310 and allows for bracket 300 to be mounted to a surface, for example a duct (see FIG. 1B). Bracket 300 may be mounted in any secure manner, for example welded, screwed, and bolted.

Figure 4:
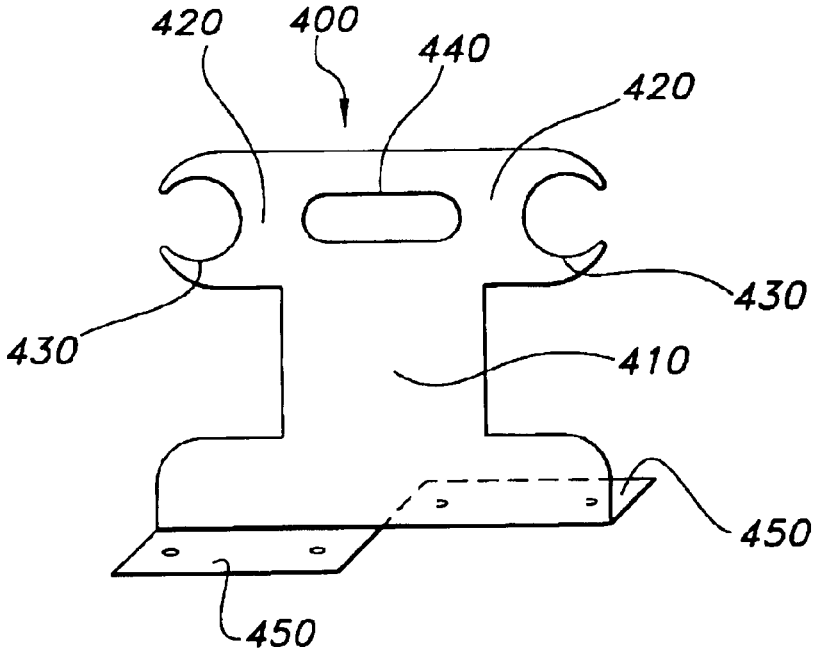
FIG. 4 is a diagram illustrating another embodiment of a mounting bracket for pipe or conduit with a built-in handle.

FIG. 4 is a diagram illustrating another embodiment of a mounting bracket for pipe or conduit with a built-in handle. Bracket 400 includes body 410, arms 420 with support guides 430. Support guides 430 may secure pipes or conduits, and may include a grommet (not shown) to assist in securing the pipe. Handle 440 connects to bracket 400 and enables bracket 400 and a completed bracket/pipe assembly (see FIG. 1B) to be easily maneuvered and transported. Handle 440 may be shaped and sized to best accommodate a human hand, a forklift, or any other lifting device. Handle 440 may be lined with a gripping surface (not shown), for example neoprene or plastic. Base 450 connects to body 410 and allows for bracket 400 to be mounted to a surface, for example a duct (see FIG. 1B). Bracket 400 may be mounted in any secure manner, for example welded, screwed, and bolted.

Figure 5:
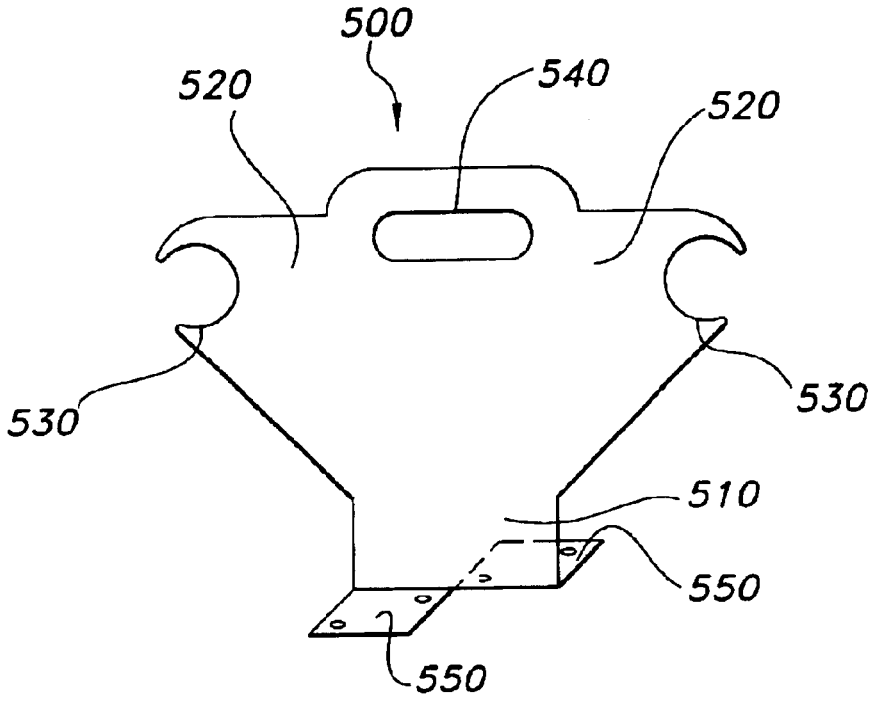
FIG. 5 is a diagram illustrating another embodiment of a mounting bracket for pipe or conduit with a built-in handle.

FIG. 5 is a diagram illustrating another embodiment of a mounting bracket for pipe or conduit with a built-in handle. Bracket 500 includes body 510, arms 520 with support guides 530. Support guides 530 may secure pipes or conduits, and may include a grommet (not shown) to assist in securing the pipe. Handle 540 connects to bracket 500 and enables bracket 500 and a completed bracket/pipe assembly (see FIG. 1B) to be easily maneuvered and transported. Handle 540 may be shaped and sized to best accommodate a human hand, a forklift, or any other lifting device. Handle 540 may be lined with a gripping surface (not shown), for example neoprene or plastic. Base 550 connects to body 510 and allows for bracket 500 to be mounted to a surface, for example a duct (see FIG. 1B). Bracket 500 may be mounted in any secure manner, for example welded, screwed, and bolted.

Figure 6:
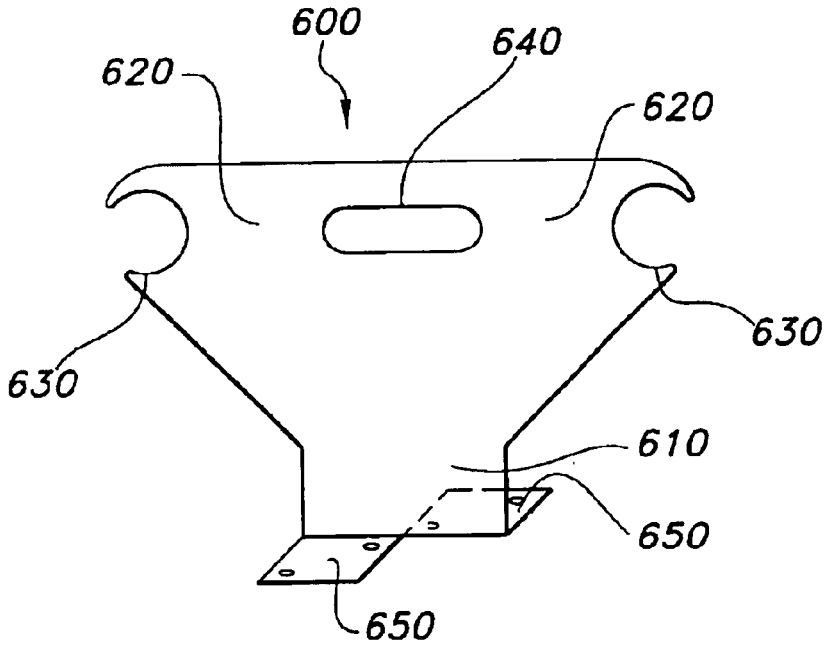
FIG. 6 is a diagram illustrating another embodiment of a mounting bracket for pipe or conduit with a built-in handle.

FIG. 6 is a diagram illustrating another embodiment of a mounting bracket for pipe or conduit with a built-in handle. Bracket 600 includes body 610, arms 620 with support guides 630. Support guides 630 may secure pipes or conduits, and may include a grommet (not shown) to assist in securing the pipe. Handle 640 connects to bracket 600 and enables bracket 600 and a completed bracket/pipe assembly (see FIG. 1B) to be easily maneuvered and transported. Handle 640 may be shaped and sized to best accommodate a human hand, a forklift, or any other lifting device. Handle 640 may be lined with a gripping surface (not shown), for example neoprene or plastic. Base 650 connects to body 610 and allows for bracket 600 to be mounted to a surface, for example a duct (see FIG. 1B). Bracket 600 may be mounted in any secure manner, for example welded, screwed, and bolted.

Figure 7:
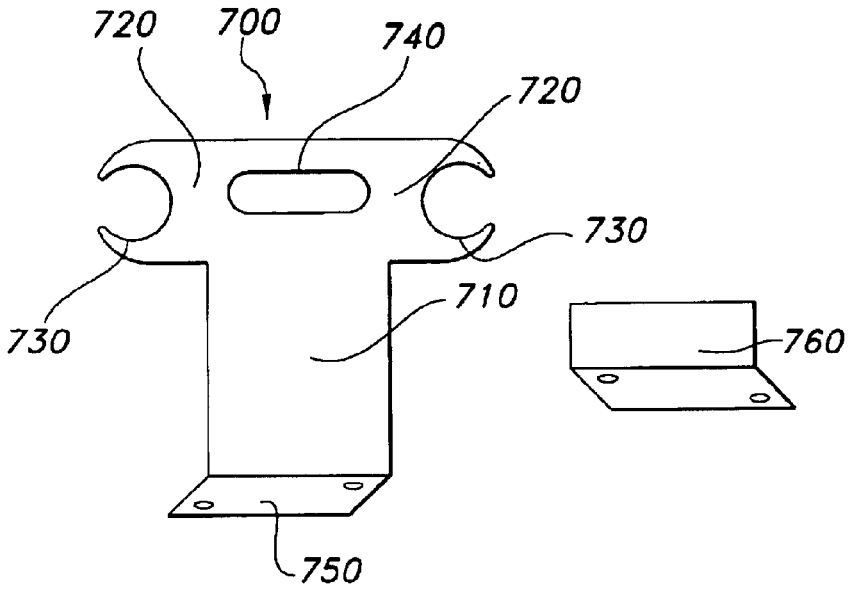
FIG. 7 is a diagram illustrating another embodiment of a mounting bracket for pipe or conduit with a built-in handle.

FIG. 7 is a diagram illustrating another embodiment of a mounting bracket for pipe or conduit with a built-in handle. Bracket 700 includes body 710, arms 720 with support guides 730. Support guides 730 may secure pipes or conduits, and may include a grommet (not shown) to assist in securing the pipe. Handle 740 connects to bracket 700 and enables bracket 700 and a completed bracket/pipe assembly (see FIG. 1B) to be easily maneuvered and transported. Handle 740 may be shaped and sized to best accommodate a human hand, a forklift, or any other lifting device. Handle 740 may be lined with a gripping surface (not shown), for example neoprene or plastic. Base 750 connects to body 710 and allows for bracket 700 to be mounted to a surface, for example a duct (see FIG. 1B). Bracket 700 may be mounted in any secure manner, for example welded, screwed, and bolted. Additionally, support back 760 may be included on the opposite side of base 750 in order to provide further support to bracket 700.

Figure 8:
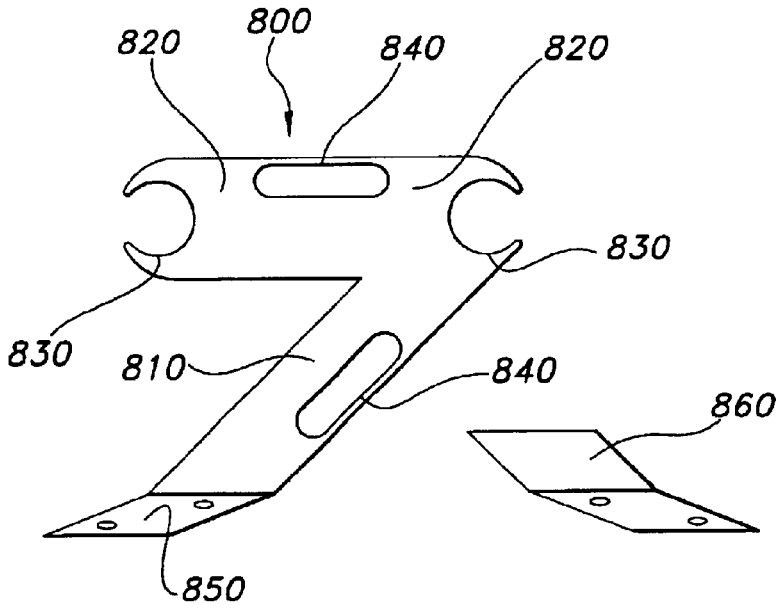
FIG. 8 is a diagram illustrating another embodiment of a mounting bracket for pipe or conduit with a built-in handle.

FIG. 8 is a diagram illustrating another embodiment of a mounting bracket for pipe or conduit with a built-in handle. Bracket 800 includes body 810, arm 820 with support guides 830. Support guides 830 may secure pipes or conduits, and may include a grommet (not shown) to assist in securing the pipe. Handles 840 connect to bracket 800 and enable bracket 800 and a completed bracket/pipe assembly (see FIG. 1B) to be easily maneuvered and transported. Handles 840 may be shaped and sized to best accommodate a human hand, a forklift, or any other lifting device. Handles 840 may be lined with gripping surface (not shown), for example neoprene or plastic. Base 850 connects to body 810 and allows for bracket 800 to be mounted to a surface, for example a duct (see FIG. 1B). Bracket 800 may be mounted in any secure manner, for example welded, screwed, and bolted. Additionally, support back 860 may be included in the opposite side of base 850 in order to provide further support to bracket 800.

Figure 9:
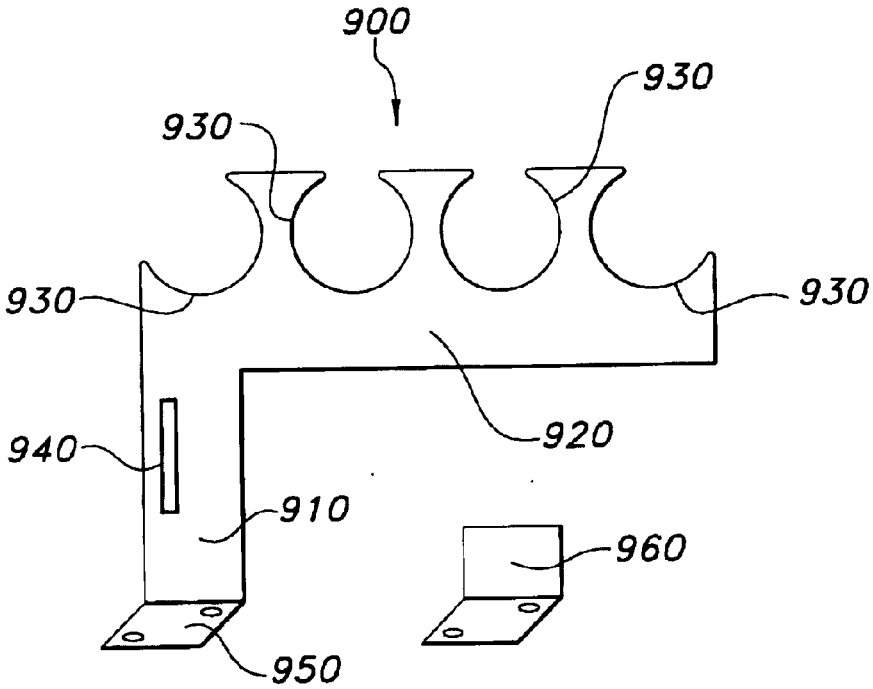
FIG. 9 is a diagram illustrating another embodiment of a mounting bracket for pipe or conduit with a built-in handle.

FIG. 9 is a diagram illustrating another embodiment of a mounting bracket for pipe or conduit with a built-in handle. Bracket 900 includes body 910, arm 920 with support guides 930. Support guides 930 may secure pipes or conduits, and may include a grommet (not shown) to assist in securing the pipe. Handle 940 connects to bracket 900 and enables bracket 900 and a completed bracket/pipe assembly (see FIG. 1B) to be easily maneuvered and transported. Handle 940 may be shaped and sized to best accommodate a human hand, a forklift, or any other lifting device. Handle 940 may be lined with a gripping surface (not shown), for example neoprene or plastic. Base 950 connects to body 910 and allows for bracket 900 to be mounted to a surface, for example a duct (see FIG. 1B). Bracket 900 may be mounted in any secure manner, for example welded, screwed, and bolted. Additionally, support back 960 may be included on the opposite side of base 950 in order to provide further support to bracket 900.

Figure 10:
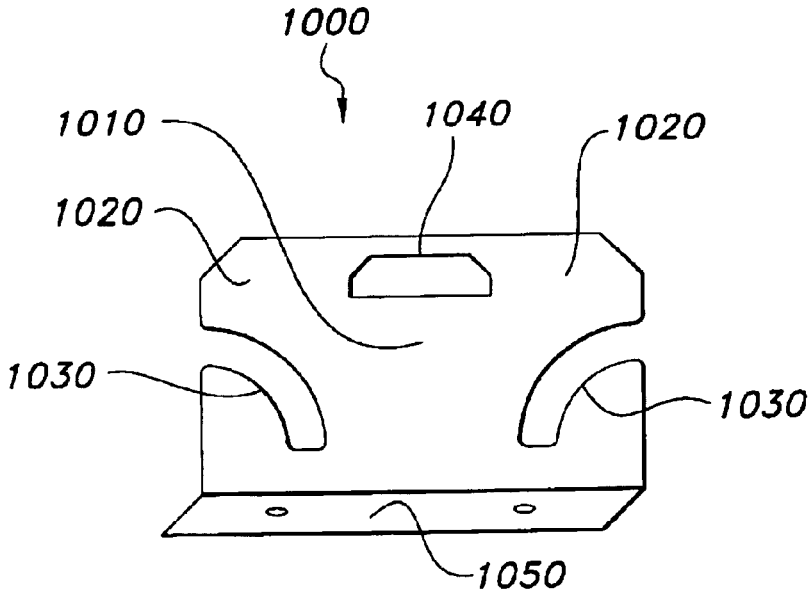
FIG. 10 is a diagram illustrating a mounting bracket with support guides providing adjustable pipe or conduit positioning with a built-in handle.

FIG. 10 is a diagram illustrating a mounting bracket with support guides providing adjustable pipe or conduit positioning with a built-in handle. Bracket 1000 includes body 1010, arms 1020 with adjustable support guides 1030. Adjustable support guides 1030 may secure pipes or conduits, and may include a grommet (not shown) to assist in securing the pipe. Adjustable support guides 1030 allow pipes or conduits (not shown) to be adjustably secured within bracket 1000. Sometimes pipes or conduits do not optimally fit within the space allocated by a non-adjustable support guide. Pipes may be moved within adjustable support guides 1030 until they are in a desired position. Handle 1040 connects to bracket 1000 and enables bracket 1000 and a completed bracket/pipe assembly (see FIG. 1B) to be easily maneuvered and transported. Handle 1040 may be shaped and sized to best accommodate a human hand, a forklift, or any other lifting device. Handle 1040 may be lined with a gripping surface (not shown), for example neoprene or plastic. Base 1050 connects to body 1010 and allows for bracket 1000 to be mounted to a surface,for example a duct (see FIG. 1B). Bracket 1000 may be mounted in any secure manner, for example welded, screwed, and bolted.

Figure 11:
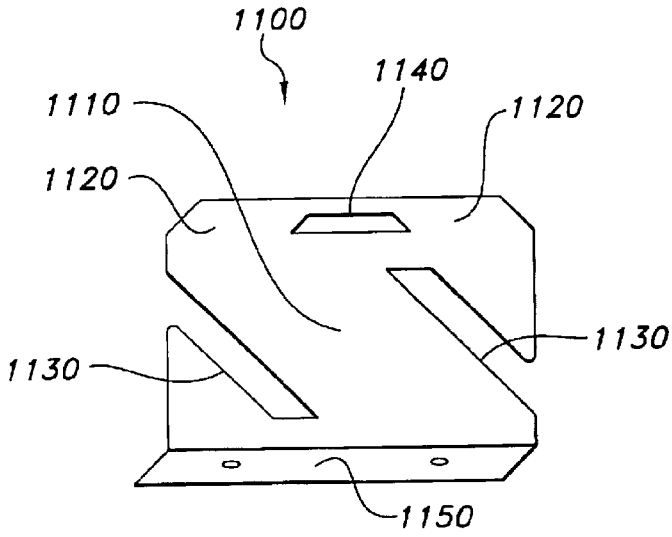
FIG. 11 is a diagram illustrating a mounting bracket with support guides providing adjustable pipe or conduit positioning with a built-in handle.

FIG. 11 is a diagram illustrating a mounting bracket with support guides providing adjustable pipe or conduit positioning with a built-in handle. Bracket 1100 includes body 1110, arms 1120 with adjustable support guides 1130. Adjustable support guides 1130 may secure pipes or conduits, and may include a grommet (not shown) to assist in securing the pipe. Adjustable support guides 1130 allow pipes or conduits (not shown) to be adjustably secured within bracket 1100. Adjustable support guides support pipes by providing friction between a part of the surface of the adjustable support guide and the pipe. The pipe's position is maintained with the friction and in one embodiment a U-clip. A grommet may also be used to secure a pipe. Sometimes pipes or conduits do not optimally fit within the space allocated by a non-adjustable support guide. Handle 1140 connects to bracket 1100 and enables bracket 1100 and a completed bracket/pipe assembly (see FIG. 1B) to be easily maneuvered and transported. Handle 1140 may be shaped and sized to best accommodate a human hand, a forklift, or any other lifting device. Handle 1140 may be lined with a gripping surface (not shown), for example neoprene or plastic. Base 1150 connects to body 1110 and allows for bracket 1100 to be mounted to a surface, for example a duct (see FIG. 1B). Bracket 1100 may be mounted in any secure manner, for example welded, screwed, and bolted.

Figure 12:
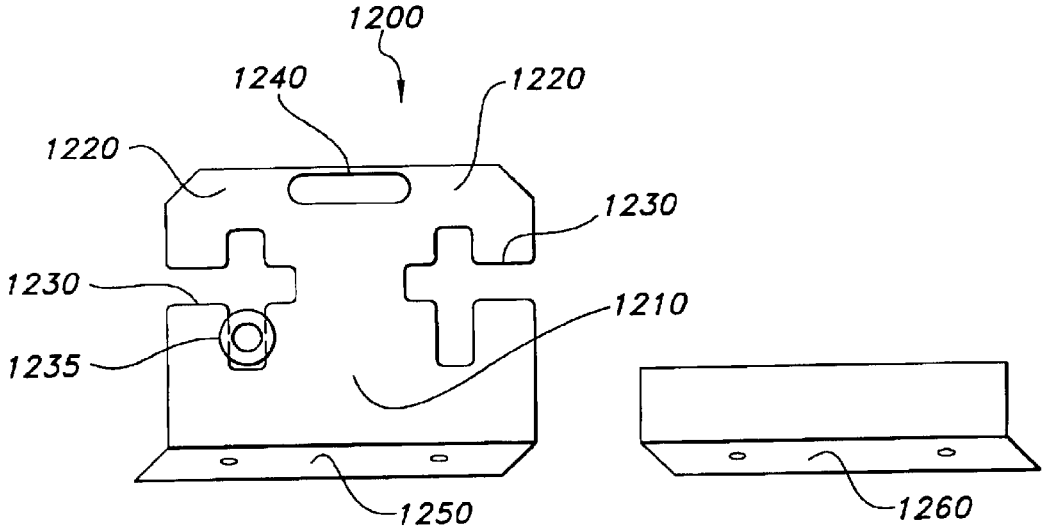
FIG. 12 is a diagram illustrating a mounting bracket with support guides providing adjustable pipe or conduit positioning with a built-in handle.

FIG. 12 is a diagram illustrating a mounting bracket with support guides providing adjustable pipe or conduit positioning with a built-in handle. Bracket 1200 includes body

1210, arms 1220 with adjustable support guides 1230. Adjustable support guides 1230 may secure pipes or conduits, and may include grommet 1235 to assist in securing the pipe. Adjustable support guides 1230 allow pipes or conduits (not shown) to be adjustably secured within bracket 1200. Sometimes pipes or conduits do not optimally fit within the space allocated by a non-adjustable support guide. Handle 1240 connects to bracket 1200 and enables bracket 1200 and a completed bracket/pipe assembly (see FIG. 1B) to be easily maneuvered and transported. Handle 1240 may be shaped and sized to best accommodate a human hand, a forklift, or any other lifting device. Handle 1240 may be lined with a gripping surface (not shown), for example neoprene or plastic. Base 1250 connects to body 1210 and allows for bracket 1200 to be mounted to a surface, for example a duct (see FIG. 1B). Bracket 1200 may be mounted in any secure manner, for example welded, screwed, and bolted. Additionally,support back 1260 may be included on the opposite side of base 1250 in order to provide further support to bracket 1200.

Figure 13:
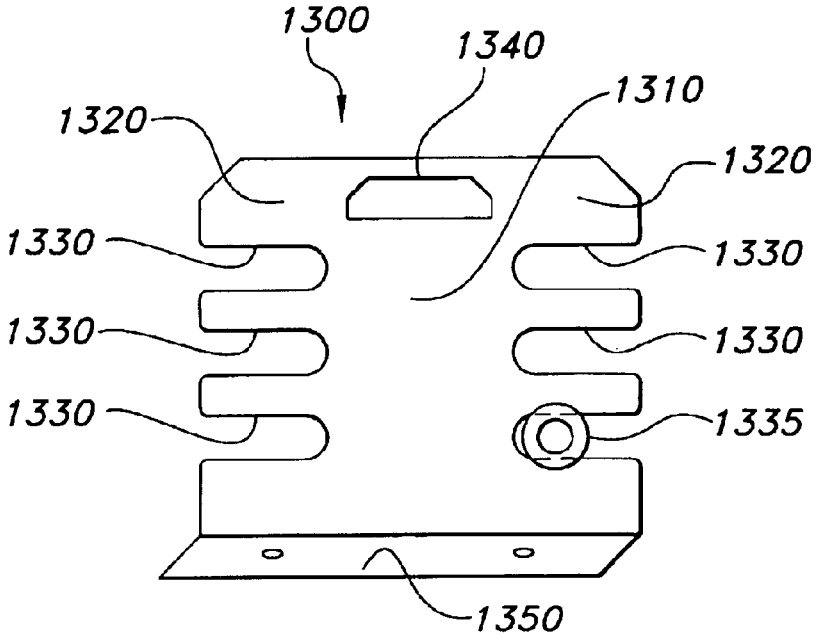
FIG. 13 is a diagram illustrating a mounting bracket with support guides providing adjustable pipe or conduit positioning with a built-in handle.

FIG. 13 is a diagram illustrating a mounting bracket with support guides providing adjustable pipe or conduit positioning with a built-in handle. Bracket 1300 includes body 1310, arms 1320 with adjustable support guides 1330. Adjustable support guides 1330 may secure pipes or conduits, and may include grommet 1335 to assist in securing each of the pipes. Adjustable support guides 1330 allow pipes or conduits (not shown) to be adjustably secured within bracket 1300. Sometimes pipes or conduits do not optimally fit within the space allocated by a non-adjustable support guide. Handle 1340 connects to bracket 1300 and enables bracket 1300 and a completed bracket/pipe assembly (see FIG. 1B) to be easily maneuvered and transported. Handle 1340 may be shaped and sized to best accommodate a human hand, a forklift,or any other lifting device. Handle 1340 may be lined with a gripping surface (not shown), for example neoprene or plastic. Base 1350 connects to body 1310 and allows for bracket 1300 to be mounted to a surface, for example a duct (see FIG. 1B). Bracket 1300 may be mounted in any secure manner, for example welded, screwed, and bolted.

Figure 14:
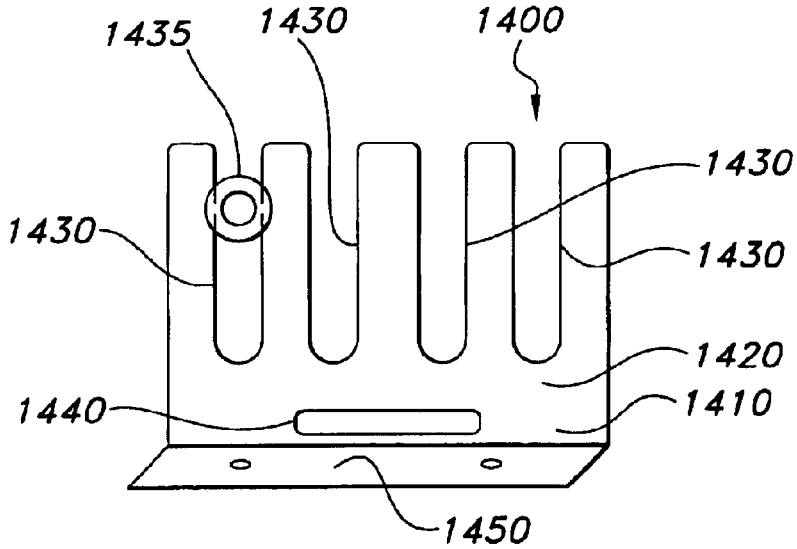
FIG. 14 is a diagram illustrating a mounting bracket with support guides providing adjustable pipe or conduit positioning with a built-in handle.

FIG. 14 is a diagram illustrating a mounting bracket with support guides providing adjustable pipe or conduit positioning with a built-in handle. Bracket 1400 includes body 1410, arm 1420 with adjustable support guides 1430. Adjustable support guides 1430 may secure pipes or conduits, and may include grommet 1435 to assist in securing the pipe. Adjustable support guides 1430 allow pipes or conduits (not shown) to be adjustably secured within bracket 1400. Sometimes pipes or conduits do not optimally fit within the space allocated by a non-adjustable support guide. Handle 1440 connects to bracket 1400 and enables bracket 1400 and a completed bracket/pipe assembly (see FIG. 1B) to be easily maneuvered and transported. Handle 1440 may be shaped and sized to best accommodate a human hand, a forklift, or any other lifting device. Handle 1440 may be lined with a gripping surface (not shown), for example neoprene or plastic. Base 1450 connects to body 1410 and allows for bracket 1400 to be mounted to a surface, for example a duct (see FIG. 1B). Bracket 1400 may be mounted in any secure manner, for example welded, screwed, and bolted. Additionally, support back 1460 may be included on the opposite side of base 1450 in order to provide further support to bracket 1400.

Figure 15:
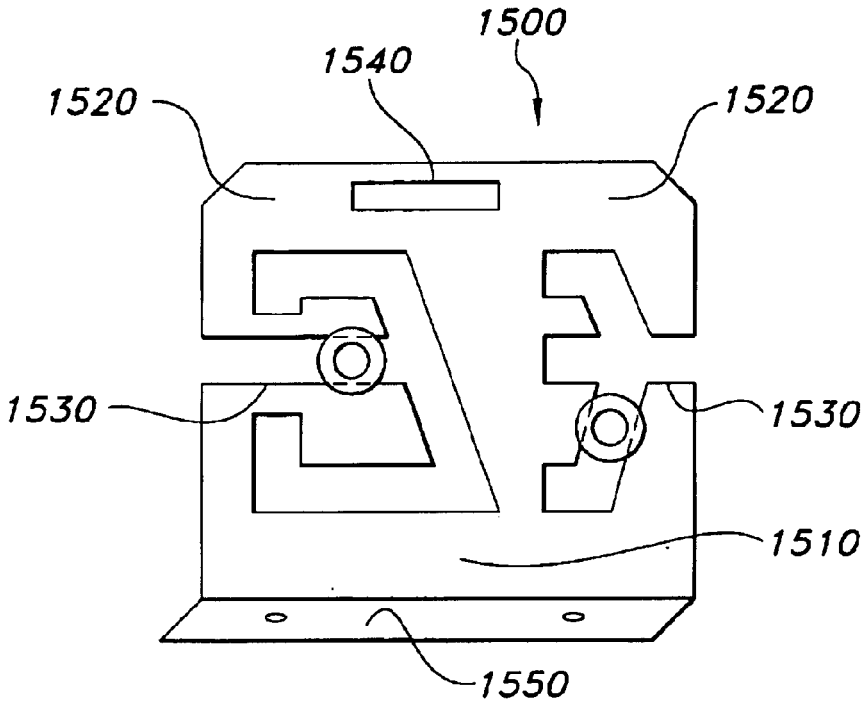
FIG. 15 is a diagram illustrating a mounting bracket with support guides providing adjustable pipe or conduit positioning with a built-in handle.

FIG. 15 is a diagram illustrating a mounting bracket with support guides providing adjustable pipe or conduit positioning with a built-in handle. Bracket 1500 includes body 1510, arms 1520 with adjustable support guides 1530. Adjustable support guides 1530 may secure pipes or conduits, and may include grommet 1535 to assist in securing the pipe. Adjustable support guides 1530 allow pipes or conduits (not shown) to be adjustably secured within bracket 1500. Sometimes pipes or conduits do not optimally fit within the space allocated by a non-adjustable support guide. Handle 1540 connects to bracket 1500 and enables bracket 1500 and a completed bracket/pipe assembly (see FIG. 1B) to be easily maneuvered and transported. Handle 1540 may be shaped and sized to best accommodate a human hand, a forklift, or any other lifting device. Handle 1540 may be lined with a gripping surface (not shown), for example neoprene or plastic. Base 1550 connects to body 1510 and allows for bracket 1500 to be mounted to a surface, for example a duct (see FIG. 1B). Bracket 1500 may be mounted in any secure manner, for example welded, screwed, and bolted.

Figure 16:
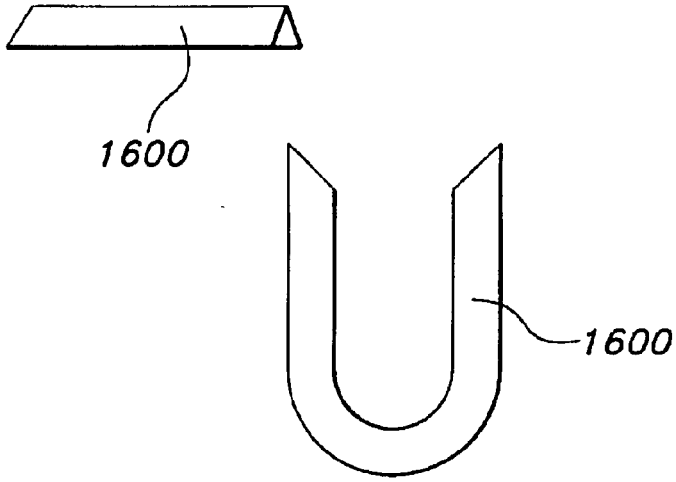
FIG. 16 is a diagram of a U-clip.

FIG. 16 is a diagram of a U-clip. U-clip 1600 clips on either side of a pipe within a support bracket in order to secure the pipe within the support bracket.

Figure 17:
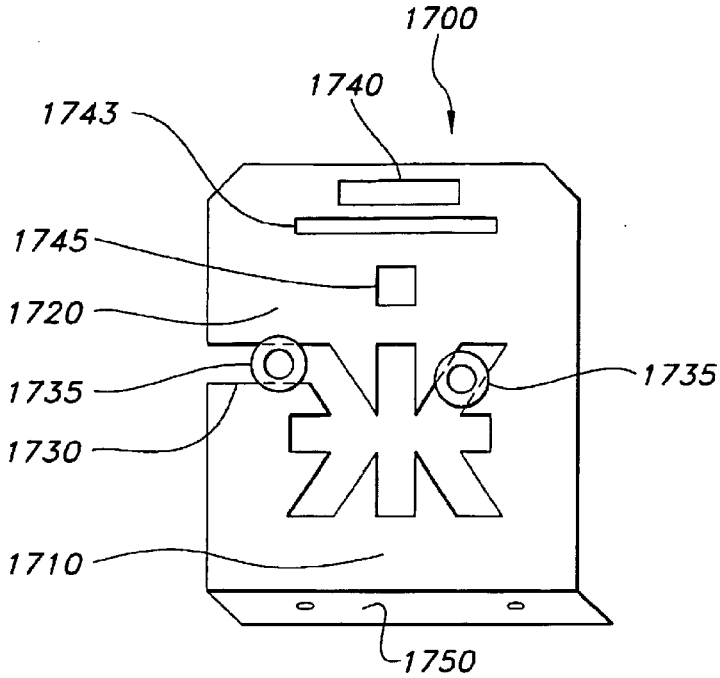
FIG. 17 is a diagram illustrating a mounting bracket with support guides providing adjustable pipe or conduit positioning with a built-in handle.

FIG. 17 is a diagram illustrating a mounting bracket with a support guide providing adjustable pipe or conduit positioning with a built-in handle. Bracket 1700 includes body 1710, arm 1720 with adjustable support guide 1730. Adjustable support guide 1730 may secure pipes or conduits, and may include grommets 1735 to assist in securing the pipe. Adjustable support guide 1730 allows pipes or conduits (not shown) to be adjustably secured within bracket 1700. In this embodiment, a single support guide may accommodate two or more pipes. Sometimes pipes or conduits do not optimally fit within the space allocated by a non-adjustable support guide. Handle 1740 connects to bracket 1700 and enables bracket 1700 and a completed bracket/pipe assembly (see FIG. 1B) to be easily maneuvered and transported. Handle 1740 is shaped and sized to best accommodate a human hand, while handle 1743 would better accommodate a forklift, and handle 1745 would accommodate a rod or bar. Handle 1740 may be lined with a gripping surface (not shown), for example neoprene or plastic. Base 1750 connects to body 1710 and allows for bracket 1700 to be mounted to a surface, for example a duct (see FIG. 1B). Bracket 1700 may be mounted in any secure manner, for example welded, screwed, and bolted.

Figure 18:
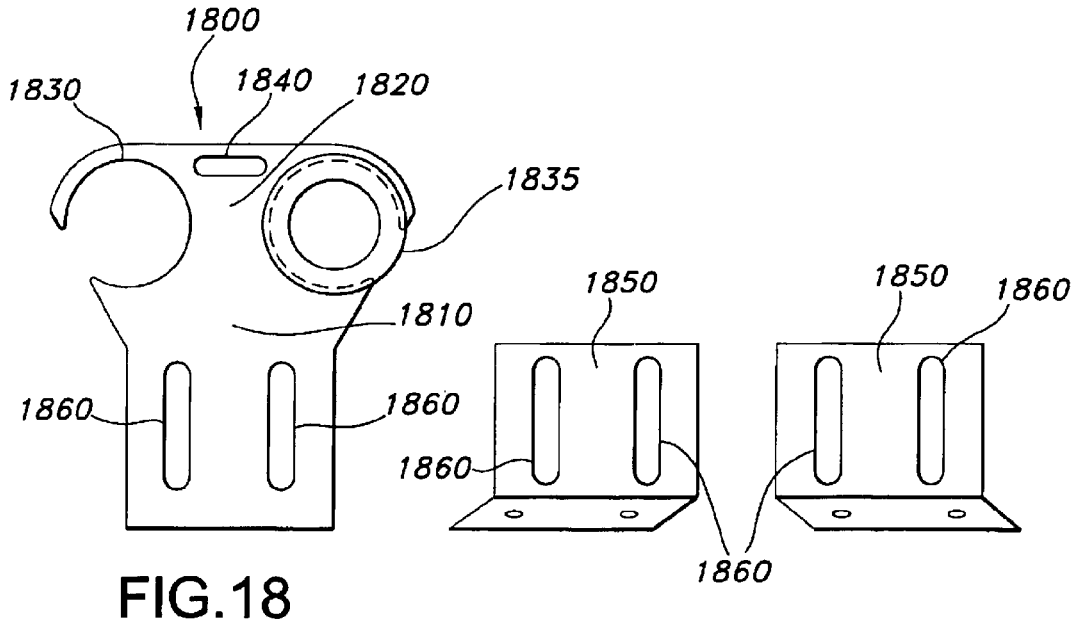
FIG. 18 is a diagram illustrating a mounting bracket with support guides providing adjustable pipe or conduit positioning with a built-in handle.

FIG. 18 is a diagram illustrating a mounting bracket with support guides providing adjustable pipe or conduit positioning with a built-in handle. Bracket 1800 includes body 1810, arm 1820 with support guides 1830. Support guides 1830 may secure pipes or conduits, and may include grommet 1835 to assist in securing the pipe. Handle 1840 connects to bracket 1200 and enables bracket 1800 and a completed bracket/pipe assembly (see FIG. 1B) to be easily maneuvered and transported. Handle 1840 may be shaped and sized to best accommodate a human hand, a forklift, or any other lifting device. Handle 1840 may be lined with a gripping surface (not shown), for example neoprene or plastic. Base 1850 connects to body 1810 and allows for bracket 1800 to be mounted to a surface, for example a duct (see FIG. 1B). Base 1850 may be mounted in any secure manner, for example welded, screwed, and bolted.

Base slots 1860 allow pipes or conduits (not shown) to be adjustably secured by bracket 1800. Body 1820 may be secured to base 1850 through base slots 1860 with screws or pins, for example. Sometimes pipes or conduits do not optimally fit within the space allocated by a non-adjustable support guide, so body 1820 may be slid up or down in relation to base 1850 in order to better accommodate placement of pipes and conduits.

Figure 19:
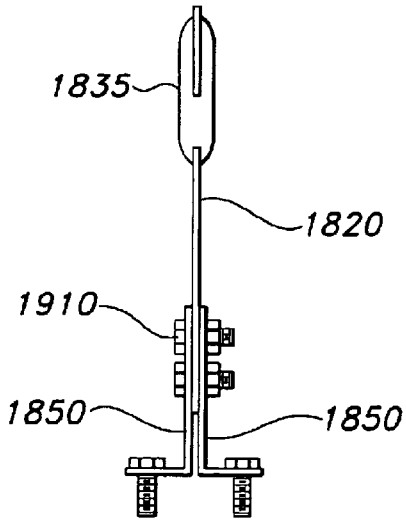
FIG. 19 is a diagram illustrating an alternative view of the mounting bracket from FIG. 18.

FIG. 19 is a diagram illustrating an alternative view of the mounting bracket from FIG. 18. Body 1820 is secured between two base plates 1850 by screws 1910. Although two base plates are illustrated, one of ordinary skill will recognize that one base plate would suffice.

Figure 20:
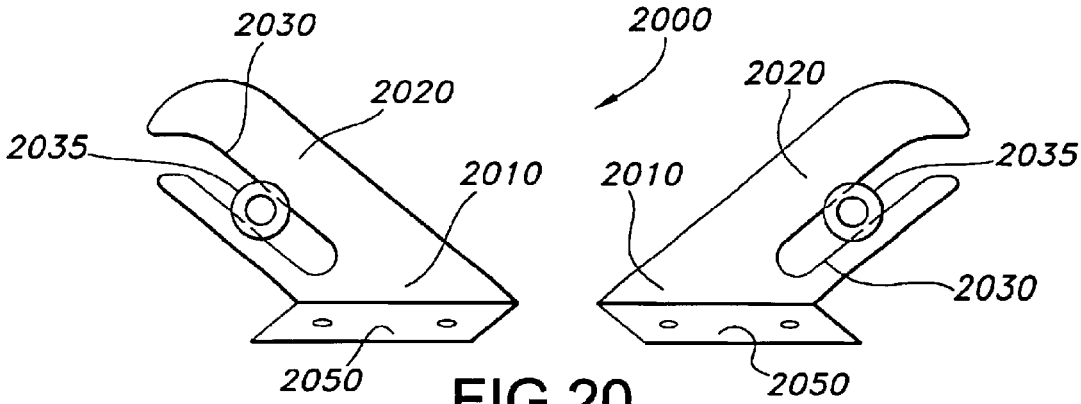
FIG. 20 is a diagram illustrating a mounting bracket with support guides providing adjustable pipe or conduit positioning.

FIG. 20 is a diagram illustrating a mounting bracket with support guides providing adjustable pipe or conduit positioning. Brackets 2000 include bodies 2010, arms 2020 with adjustable support guides 2030. Adjustable support guides 2030 may secure pipes or conduits, and may include grommet 2035 to assist in securing the pipe. Adjustable support guides 2030 allow pipes or conduits (not shown) to be adjustably secured within bracket 2000. Sometimes pipes or conduits do not optimally fit within the space allocated by a non-adjustable support guide. Base 2050 connects to body 2010 and allows for bracket 2000 to be mounted to a surface, for example a duct (see FIG. 1B). Bracket 2000 may be mounted in any secure manner, for example welded, screwed, and bolted.

Figure 21:
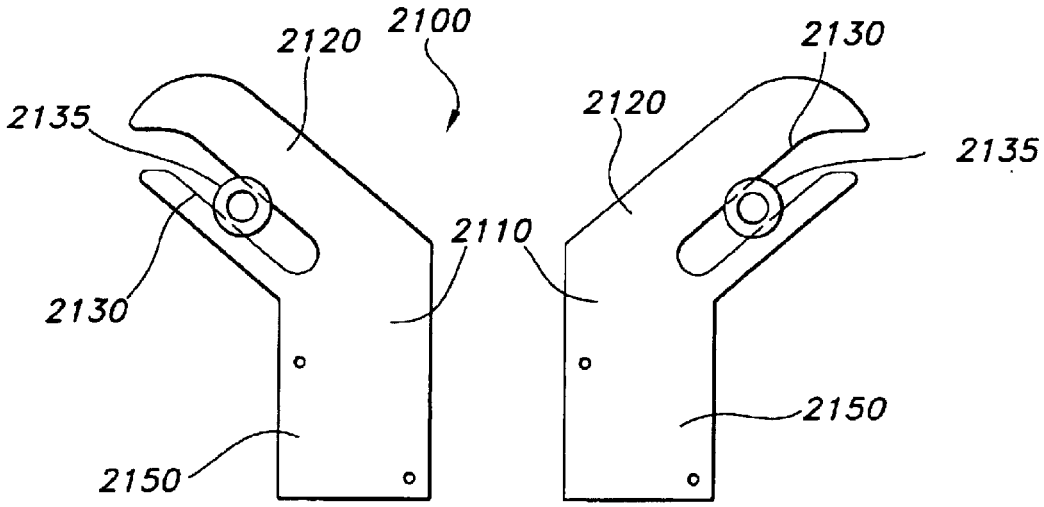
FIG. 21 is a diagram illustrating a mounting bracket with support guides providing adjustable pipe or conduit positioning.

FIG. 21 is a diagram illustrating a mounting bracket with support guides providing adjustable pipe or conduit positioning. Brackets 2100 include bodies 2110, arms 2120 with adjustable support guides 2130. Adjustable support guides 2130 may secure pipes or conduits, and may include grommet 2135 to assist in securing the pipe. Adjustable support guides 2130 allow pipes or conduits (not shown) to be adjustably secured within bracket 2100. Sometimes pipes or conduits do not optimally fit within the space allocated by a non-adjustable support guide. Base 2150 connects to body 2110 and allows for bracket 2100 to be mounted to a surface, for example a duct (see FIG. 1B). Bracket 2100 may be mounted in any secure manner, for example welded, screwed, and bolted.

Figure 23:
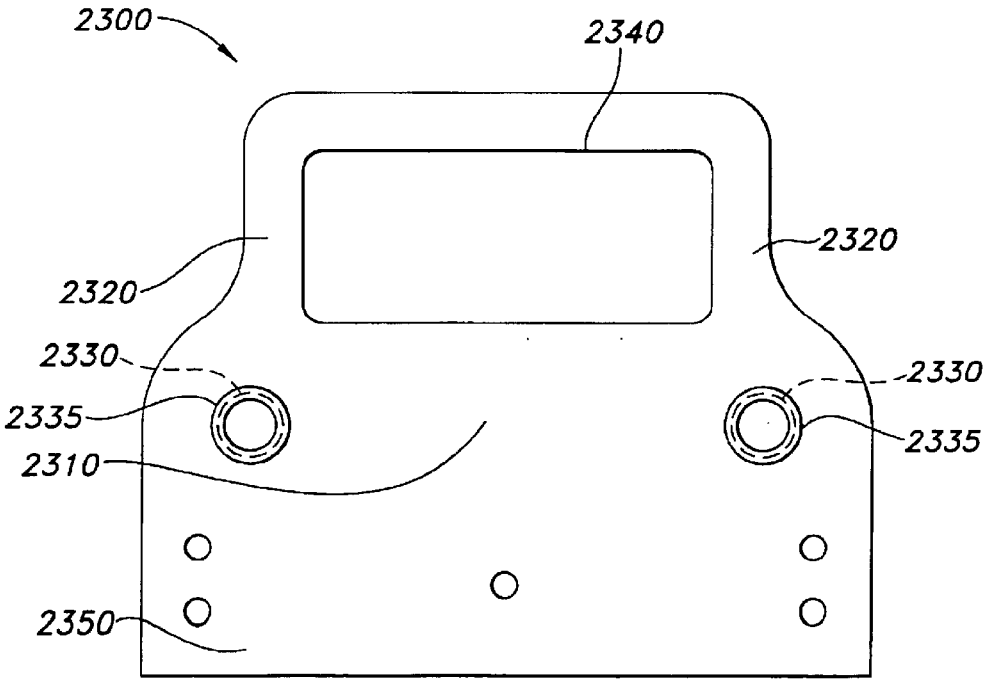
FIG. 23 is a diagram illustrating a mounting bracket with support guides and a built-in handle.

FIG. 23 is a diagram illustrating a mounting bracket with support guides and a built-in handle. Bracket 2300 includes body 2310 and arms 2320. Support guides 2330 may secure pipes or conduits, and may include grommet 2335 to assist in securing the pipe. Support guides 2330 allow pipes or conduits (not shown) to be secured within bracket 2300. Handle 2340 connects to bracket 2300 and enables bracket 2300 and a completed bracket/pipe assembly (see FIG. 1B) to be easily maneuvered and transported. Handle 2340 may be shaped and sized to best accommodate a human hand, a forklift, or any other lifting device. Handle 2340 may be lined with a gripping surface (not shown), for example neoprene or plastic. Base 2350 connects to body 2310 and allows for bracket 2300 to be mounted to a surface, for example a case, a box, a container, a door, and any other surface for which a handle could provide advantageous. Bracket 2300 may be mounted in any secure manner, for example welded, screwed, and bolted.

Figure 22:
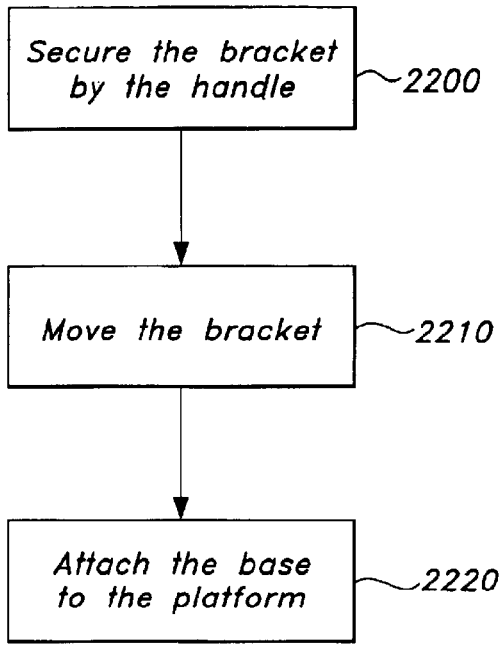
FIG. 22 is a flow diagram illustrating a method of using the invention.

FIG. 22 is a flow diagram illustrating a method of transporting a bracket supporting a pipe, the bracket having a handle, a base coupled to the handle, and a platform upon which the bracket will be secured. The platform may be ducts, a wall, a ceiling, joists, or any other surface along which the pipe needs support. In block 2200, secure the bracket by the handle. In block 2210, move the bracket. In block 2220, attach the base to the platform.

One advantage of the invention is that a pressure gauge may be attached to a bracket-pipe-gauge system, the type commonly installed in HVAC systems. The bracket-pipe-gauge system may have brackets with handles, the brackets supporting pipes, for example the system illustrated in FIG. 1B. The entire system may be pressurized in order to verify its integrity, and shipped to a customer under pressure. The customer receives it and knows that the system is secure, without leaks, and manipulation by the handle on the bracket will help to keep the seals and the individual parts intact.

One skilled in the art will recognize from the previous description and from the figures and claims that modifications and changes can be made to the invention without departing from the scope of the invention defined in the following claims.

What is claimed is:

1. A mounting bracket comprising:

a generally rectangular, flat body having an outside edge, a front and a back;

a first support guide for a first pipe positioned proximate to and intersecting with the outside edge, the first support guide comprising a substantially complete enclosure;

a second support guide for a second pipe positioned proximate to and intersecting with the outside edge, the second support guide comprising a substantially complete enclosure and positioned proximate to an edge that is opposite the edge proximate to the first support guide;

a grommet mounted within each of the first and second support guides, and having a complete enclosure;

a handle formed within the boundary of and proximate to the outside edge of the body, for lifting the mounting bracket; and maintaining an alignment between the first and second pipes with respect to one another a base coupled to and extending transversely outwardly from the outside edge of the body and further providing support to the body.

2. The mounting bracket of claim 1 wherein the enclosure of the first support guide permits movement of the first pipe in a direction perpendicular to a plane formed by the flat body and prevents movement of the first pipe in a direction parallel to the plane formed by the flat body.

3. The mounting bracket of claim 1 wherein the first support guide is generally circular.

4. The mounting bracket of claim 1 wherein the base has a first flat panel extending towards the front of the body along a first portion of the outside edge.

5. The mounting bracket of claim 4 wherein the base has a second flat panel extending towards the back of the body along a second portion of the outside edge, the first and second portions adjacent to one another.

6. The mounting bracket of claim 5 wherein each panel of the base is generally rectangular.

7. In combination, a first and second pipe mounted within a bracket, the bracket comprising:

a generally rectangular, flat body having an outside edge, a front and a back;

a first support guide positioned proximate to and intersecting with the outside edge, the first support guide comprising a substantially complete enclosure;

a second support guide positioned proximate to and intersecting with the outside edge, the second support guide comprising a substantially complete enclosure;

a grommet mounted within each of the first and second support guides, and having a complete enclosure;

a handle formed within the boundary of and proximate to the outside edge of the body, for lifting the mounting bracket; and maintaining an alignment between the first and second pipes with respect to one another a base coupled to and extending transversely outwardly from the outside edge of the body and further providing support to the body.

8. A mounting bracket comprising:

a generally rectangular, flat body having an outside edge, a front and a back;

a generally circular first support guide for a first pipe positioned proximate to and within the boundary of the outside edge, the first support guide comprising a substantially complete enclosure permitting movement of the first pipe in a direction perpendicular to a plane formed by the flat body and preventing movement of the first pipe in a direction parallel to the plane formed by the flat body;

a generally circular second support guide for a second pipe positioned proximate to and intersecting with the outside edge, the second support guide comprising a substantially complete enclosure permitting movement of the second pipe in a direction perpendicular to a plane formed by the flat body and preventing movement of the first pipe in a direction parallel to the plane formed by the flat body, wherein the second support guide is positioned proximate to an edge that is opposite the edge proximate to the first support guide;

a grommet mounted within each of the first and second support guides, and having a complete enclosure;

a handle formed within the boundary of and proximate to the outside edge of the body, for lifting the mounting bracket; and maintaining an alignment between the first and second pipes with respect to one another a base coupled to and extending transversely outwardly from the outside edge of the body and further providing support to the body.

9. The mounting bracket of claim 8 wherein the base has a first flat panel extending towards the front of the body along a first portion of the outside edge.

10. The mounting bracket of claim 9 wherein the base has a second flat panel extending towards the back of the body along a second portion of the outside edge, the first and second portions adjacent to one another.

11. The mounting bracket of claim 10 wherein each panel of the base is generally rectangular.

12. A method of transporting a mounting bracket supporting a pipe, the method comprising:

securing the bracket by a handle, the bracket comprising a generally rectangular, flat body having an outside edge, a front and a back, a first support guide positioned proximate to and intersecting with the outside edge, the first support guide comprising a substantially complete enclosure, a second support guide positioned proximate to and intersecting with the outside edge, the second support guide comprising a substantially complete enclosure and positioned proximate to an edge that is opposite the edge proximate to the first support guide, a grommet mounted within each of the first and second support guides and having a complete enclosure, the handle formed within the boundary of and proximate to the outside edge of the body, for lifting the mounting bracket, a base coupled to and extending transversely outwardly from the outside edge of the body and further providing support to the body; and maintaining an alignment between the first and second pipes with respect to one another moving the bracket by the handle, wherein the bracket and the first support guide provide support to the pipe while moving the bracket.

13. The method of 12 further comprising:

attaching the base to a platform.

* * * * *